US008790127B1

(12) United States Patent
Wilkolaski

(10) Patent No.: US 8,790,127 B1
(45) Date of Patent: Jul. 29, 2014

(54) PLUG-TO-SOCKET KEYING DEVICE AND SYSTEM

(71) Applicant: Curbell Medical Products, Inc., Orchard Park, NY (US)

(72) Inventor: Edward A. Wilkolaski, Lancaster, NY (US)

(73) Assignee: Curbell Medical Products, Inc., Orchard Park, NY (US)

( * ) Notice: Subject to any disclaimer, the term of this patent is extended or adjusted under 35 U.S.C. 154(b) by 45 days.

(21) Appl. No.: 13/750,670

(22) Filed: Jan. 25, 2013

(51) Int. Cl.
*H01R 13/64* (2006.01)
*H01R 13/645* (2006.01)

(52) U.S. Cl.
CPC ..... *H01R 13/6456* (2013.01)
USPC ..... 439/378

(58) Field of Classification Search
USPC ..... 439/378, 172–173, 106, 222
See application file for complete search history.

(56) References Cited

U.S. PATENT DOCUMENTS 4,391,480 A 7/1983 Mina
4,585,286 A 4/1986 Parr
6,109,977 A 8/2000 Baxter et al.
6,328,581 B1 * 12/2001 Lee et al. ..... 439/106
6,669,495 B2 12/2003 Philips et al.
6,908,320 B2 6/2005 Genduso et al.
7,094,085 B2 8/2006 Bona et al.
7,168,968 B1 1/2007 Li
7,168,969 B1 * 1/2007 Wang ..... 439/173
7,597,570 B2 10/2009 So
7,632,146 B2 12/2009 Murphy et al.
8,512,056 B2 * 8/2013 Wen et al. ..... 439/172

FOREIGN PATENT DOCUMENTS

GB 2449066 A 12/2008
GB 2472347 A 2/2011

* cited by examiner

*Primary Examiner* — Jean F Duverne
(74) *Attorney, Agent, or Firm* — Hodgson Russ LLP

(57) ABSTRACT

A plug-to-socket keying device includes a housing having an adjustment recess having a detent portion. A plurality of electrical contacts are carried by the housing. An alignment key is provided with a mating end. An indexing segment is connected to the mating end, which is shaped to define a plurality of rotational index positions. The alignment key is axially movable relative to the adjustment recess into a set position. The indexing segment is movable from the detent portion so as to allow rotation of the alignment key relative to the housing. A spring is arranged to bias the alignment key toward the set position. The alignment key is settable to a chosen one of the plurality of rotational index positions by moving the alignment key into its adjustment position and rotating the alignment key to the chosen rotational index position.

16 Claims, 4 Drawing Sheets

PLUG-TO-SOCKET KEYING DEVICE AND SYSTEM

FIELD OF THE INVENTION

The present invention is generally directed to electrical connectors for electronic devices.

BACKGROUND OF THE INVENTION

Electrical connectors are often specific to an electronic device type, device manufacturer, and/or device product line, and are therefore electrically incompatible with each other despite being able to physically mate. If a user mistakenly uses an incorrect electrical connector for a device, many problems may occur. For instance, a device may be damaged and/or its useful life shortened if the wrong electrical connector is used. Additionally, accidental connection of incompatible devices could lead to incorrect signals being exchanged or malfunction of a device. Thus, electrical connectors are often designed in such a way that they will not mate with incompatible devices.

Despite the risk of electrical connectors being used with incompatible devices, there may be manufacturing and economic advantages of making a universal electrical connector type. There are also environmental and consumer benefits of producing a universal electrical connector. For example, electrical connectors for obsolete devices are often discarded by users because the connectors are not suitable for use with other devices. Producing a universal electrical connector would allow for the recycling and reuse of electrical connectors.

While a universal electrical connector has several advantages, the risk of incompatible connection can outweigh the advantages of producing a universal electrical connector. What is needed is an electrical connector that prohibits accidental incompatible connection, but provides electrical connection for a multitude of electronic devices.

SUMMARY OF THE INVENTION

The present invention can be embodied as a plug-to-socket keying device. The device can include a housing having an adjustment recess therein, the adjustment recess including a detent portion. A plurality of electrical contacts may be carried by the housing, the plurality of contacts facing a first direction relative to the housing. An alignment key can be provided. The alignment key can include a mating end facing the first direction and an indexing segment connected to the mating end. The indexing segment may be shaped to define a plurality of rotational index positions of the alignment key. The alignment key can be axially movable relative to the adjustment recess between a set position, where the indexing segment is received by the detent portion so as to prevent rotation of the alignment key relative to the housing. The alignment key can be axially movable into an adjustment position, where the indexing segment is removed from the detent portion so as to allow rotation of the alignment key relative to the housing. A spring may be arranged to bias the alignment key toward the set position. The alignment key can be settable to a chosen one of the plurality of rotational index positions by temporarily moving the alignment key into its adjustment position and rotating the alignment key to the chosen rotational index position. An angular orientation of the mating end of the alignment key can be configurable by a user.

In another embodiment of the invention, a plug-to-socket keying system is provided. The system can include a keying device as summarized above, and a receiving device that includes a receiving housing. A plurality of mating electrical contacts may be carried by the receiving housing. The plurality of mating electrical contacts can be configured to mate with the plurality of electrical contacts of the keying device. An alignment key receiver may be shaped to receive the mating end of the alignment key of the keying device. The alignment key receiver can be fixed relative to the receiving housing.

DETAILED DESCRIPTION OF THE INVENTION

Figure 1:
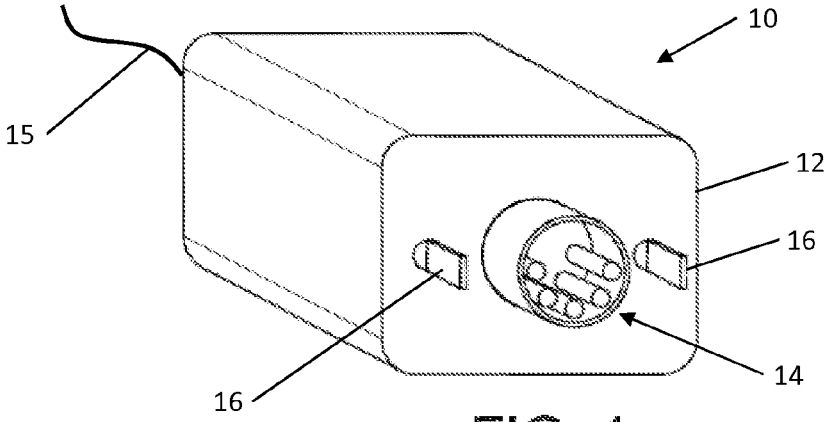
FIG. 1 is a front perspective view of a plug-to-socket keying device in accordance with an embodiment of the present invention.
Figure 2:
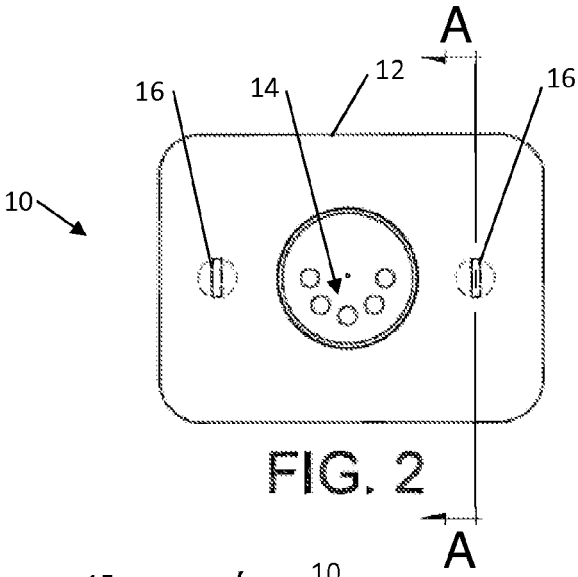
FIG. 2 is a front view of the device shown in FIG. 1.

FIG. 1 shows a plug-to-socket keying device 10 formed in accordance with an embodiment of the present invention. The device 10 is an electrical connector that can be used to connect electronic devices. While the present invention is described with respect to standard electrical connectors or interfaces, particularly used in the medical field, it will be understood that the present invention may be used with any suitable electrical connectors, including those used outside the medical field and electrical connectors that are not a recognized standard.

In one embodiment, the plug-to-socket keying device 10 generally includes a housing 12 that carries a plurality of electrical contacts 14. The plurality of electrical contacts 14 can be in electrical communication with an electronic device (not shown) via cable 15. Alternatively, the device 10 can be integrally formed with an electronic device (not shown), or include a second plurality of electrical contacts (not shown) for mating with electrical contacts of an electronic device. The plurality of electrical contacts 14 can be arranged in any suitable mating arrangement. For example, FIG. 1 shows the electrical contacts 14 arranged in a 5-pin DIN arrangement. However, the present invention is not limited to this arrangement of the electrical contacts 14. Instead, the plurality of electrical contacts 14 can be arranged in any manner appropriate for mating with a corresponding set of mating electrical contacts for carrying electrical signals and/or ground. Non-limiting examples of connector arrangements for the electrical contacts 14 include plug-and-socket connectors, hermaphroditic connectors, blade connectors, ring connectors, and other standard or non-standard connector arrangements. In the medical field, for example, D-sub and DIN arrangements may be particularly suitable arrangements for the electrical contacts 14. Additionally, the electrical contacts 14 can be male or female electrical contacts, or a combination of male and female electrical contacts. In another embodiment of the present invention, the electrical contacts 14 are recessed within the housing 12.

Figure 4A:
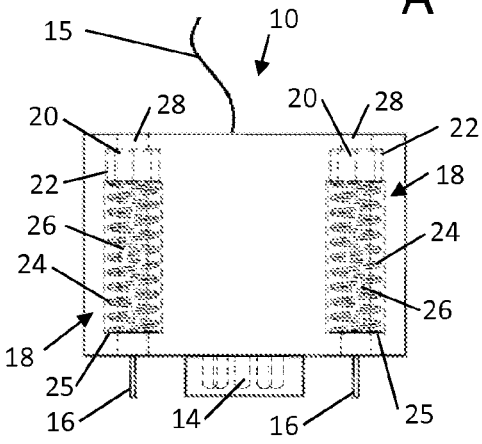
FIG. 4A is top view of the device shown in FIG. 1 placed in a set position.
Figure 4B:
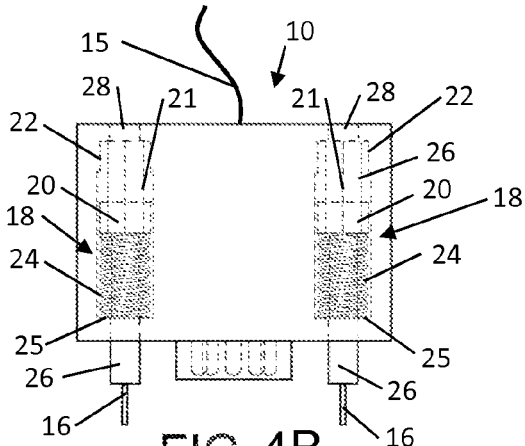
FIG. 4B is top view of the device shown in FIG. 1 placed in an adjustment position.

Device 10 further includes at least one mating end 16 of an alignment key 18 (shown in FIGS. 4A, 4B). In one embodiment, shown in the figures, there are two mating ends 16. Each mating end 16 may be located on the same side of the housing 12 as the electrical contacts 14. In an embodiment, the mating end 16 has a geometric shape. For example, the mating end 16 can be rectangularly shaped. Although the mating ends 16 shown in the figures are male-shaped, it is contemplated that the device 10 can have female mating end(s) (e.g. a recess) or a combination of one or more male mating ends and one or more female mating ends.

Reference is now made to FIGS. 4A, 4B, which are top views of the plug-to-socket keying device 10, which details an embodiment of the present invention showing an alignment key 18 located at least partially within housing 12 of device 10. As shown, the alignment key 18 includes mating end 16 and an indexing segment 20. The housing includes an adjustment recess 21, the adjustment recess 21 having a detent portion 22. The alignment key 18 is axially movable relative to the adjustment recess 21 between a set position (FIG. 4A) and an adjustment position (FIG. 4B). In the set position shown in FIG. 4A, the indexing segment 20 is received by the detent portion 22 so as to prevent rotation of the alignment key 18 about its axis 19 relative to the housing 12. The indexing segment 20 and detent portion 22 thus can have corresponding shapes, which allow the indexing segment 20 to be slidably received by the detent portion 22, but do not allow the indexing segment 20 to rotate relative to the detent portion 22. The indexing segment and detent portion 22 can have corresponding polygonal shapes, for example octagonal or hexagonal shapes, to define a plurality of rotational index positions of the alignment key 18. A spring 24 can bias the alignment key 18 toward the set position (FIG. 4A). The adjustment recess 21 can be provided with a radial shoulder 25 axially spaced from the detent portion 22 of the adjustment recess. The spring 24 can be a coil spring arranged such that a first end of the spring engages radial shoulder 25 and a second end of the spring engages indexing segment 20 to bias alignment key 18 in an axial direction toward the set position (FIG. 4A).

Figure 3:
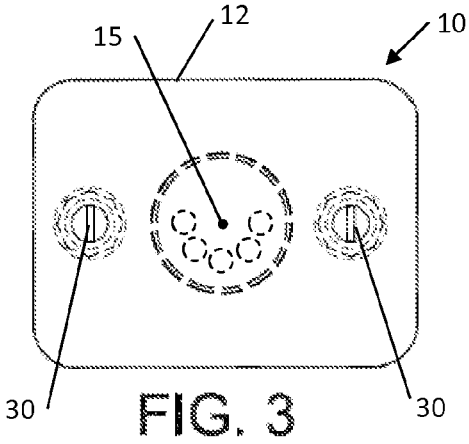
FIG. 3 is a rear view of the device shown in FIG. 1.
Figure 5:
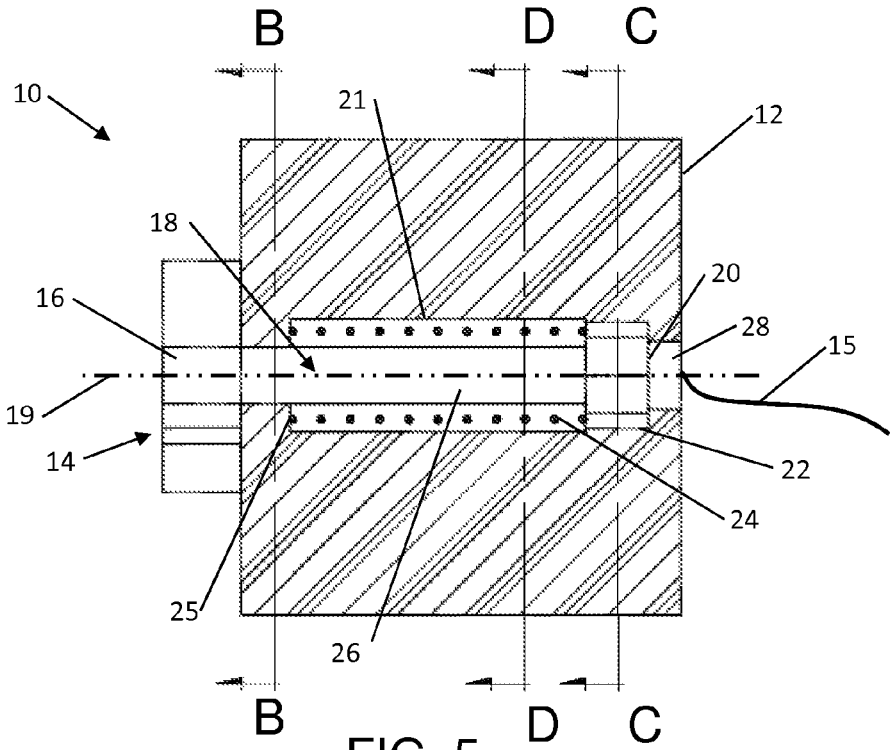
FIG. 5 is a cross-sectional view taken along A-A (shown in FIG. 2) through a housing and a spring of the keying device, wherein an alignment key of the keying device is not sectioned.
Figure 6:
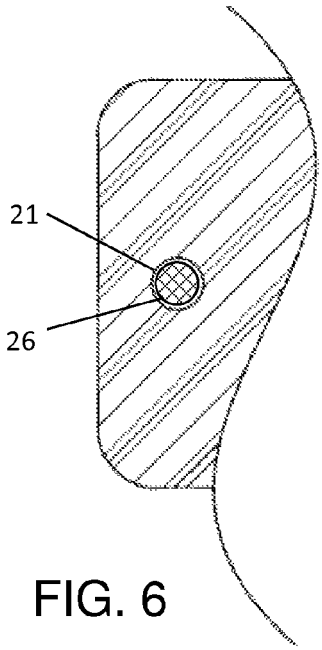
FIG. 6 is a cross-sectional view taken along B-B (shown in FIG. 5)
Figure 7:
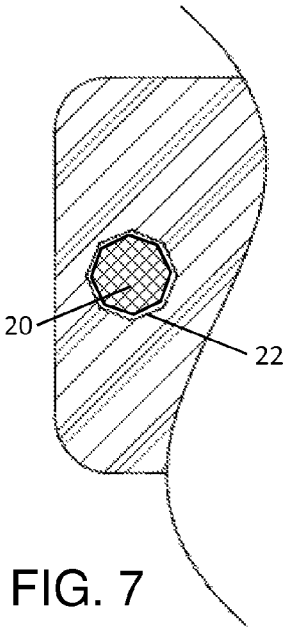
FIG. 7 is a cross-sectional view taken along C-C (shown in FIG. 5)
Figure 8:
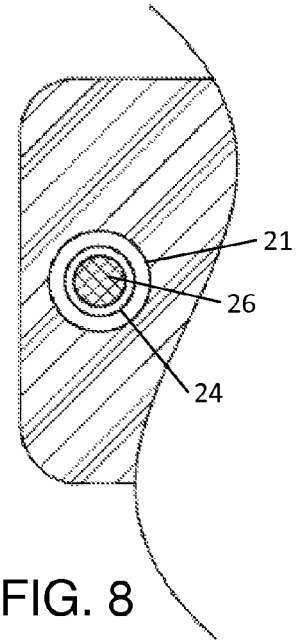
FIG. 8 is a cross-sectional view taken along D-D (shown in FIG. 5)

FIG. 4B shows the alignment key 18 moved into the adjustment position. In the adjustment position shown in FIG. 4B, the indexing segment 20 is removed from the detent portion 22 so as to allow rotation of the alignment key 18 about axis 19 relative to the housing 12. The mating end 16 can be connected in fixed relation to indexing segment 20 such that rotation of the indexing segment 20 will correspondingly rotate the mating end 16 of alignment key 18. In one embodiment, the adjustment recess 21 further includes a tool access portion 28 to permit access to the alignment key 18. The tool access portion 28 can be located on a side of the housing 12 opposite the side of where the mating end 16 of the alignment key 18 is located such that access is permitted through the housing. In this manner, a tool can be used to push the alignment key 18 to the left as viewed in FIG. 5 to move the alignment key 18 from the set position (FIG. 4A) to the adjustment position (FIG. 4B). For this purpose, a tool recess 30 (FIG. 3) may be included on an end of the alignment key 18 opposite mating end 16. For example, the tool recess 30 can be configured to receive a screw-driver. Alternatively, the alignment key 18 may be urged from the set position to the adjustment position by gripping and pulling on mating end 16.

Once the alignment key 18 is placed into the adjustment position (FIG. 4B), the user can apply a rotational force to the alignment key using a screw-driver engaging tool recess 30, or by rotating mating end 16, to rotate the alignment key 18 about axis 19. After rotating the alignment key 18 to a selected rotational index position, the alignment key may be released so that spring 24 urges the alignment key 18 back into the set position (FIG. 4A) with indexing segment 20 received in the detent portion 22 of adjustment recess 21. The alignment key 18 may be placed into the set position (FIG. 4A) once the indexing segment 20 is aligned to one of the predetermined rotational index positions defined by the complimentary shapes of the indexing segment 20 and detent portion 22. In this manner, the indexing segment 20 can be slidably received by the detent portion 22. Thus, the alignment key 18 can be settable to a chosen one of the plurality of rotational index positions by temporarily moving the alignment key 18 into its adjustment position (FIG. 4B) and rotating the alignment key 18 to the chosen rotational index position.

In an embodiment not shown in the drawings, the plug-to-socket keying device 10 can be provided without a tool access portion 28 in its housing 12. Instead, as mentioned above, a user could simply pull on the mating end 16 of alignment key 18 to move the indexing segment 20 out of detent portion 22, thereby placing the alignment key in the adjustment position (FIG. 4B). Once placed in the adjustment position (FIG. 4B), the alignment key 18 can be rotated by hand.

In yet another embodiment (not shown), adjustment recess 21 and alignment key 18 could be configured such that the mating end 16 of the alignment key can be pushed toward the housing 12 to move the indexing segment 20 out of detent portion 22 to move the alignment key from the set position (FIG. 4A) to the adjustment position (FIG. 4B). In this case, the indexing segment 20 and detent portion 22 could be located generally near a mid-region of housing 12 or closer to mating end 16 relative to the location shown in the figures, and the spring 24 could be arranged with an opposite directional bias from the arrangement shown in the figures.

FIGS. 5-8 show further details of the alignment key 18. In the embodiment shown in these figures, the alignment key 18 includes a rod 26 connecting the mating end 16 to the indexing segment 20. The spring 24 may be arranged about at least a portion of the rod 26. The indexing segment 20 can be fixed to the rod 26. For example, the indexing segment 20 and rod 26 can be integrally formed. However, it is possible for the indexing segment 20 to slide along the rod 26. In this latter embodiment, a mechanism can be provided to allow the indexing segment 20 to be slidable relative to the rod 26, but allow the indexing segment 20 to apply a rotational force to the rod 26 such that the mating end 16 can be rotated. For example, one or more slots could be provided along the axis of the rod 26, and the indexing segment 20 could have a keyway that is retained within the slot (not shown).

Figure 9:
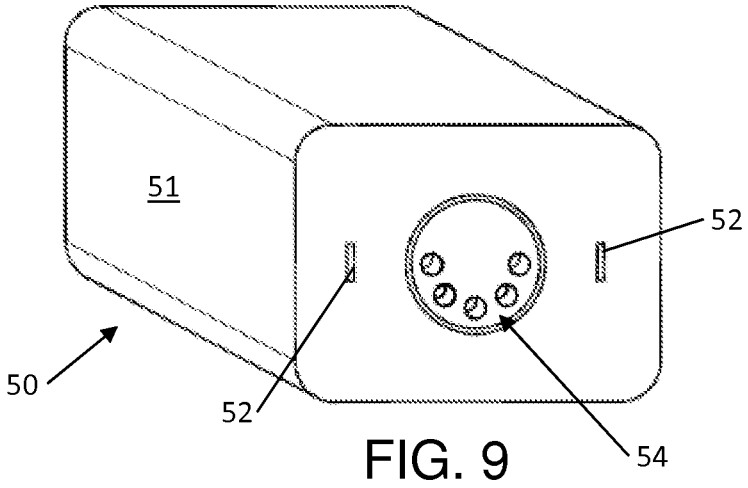
FIG. 9 is front perspective view of a receiving device in accordance with an embodiment of the present invention.
Figure 10:
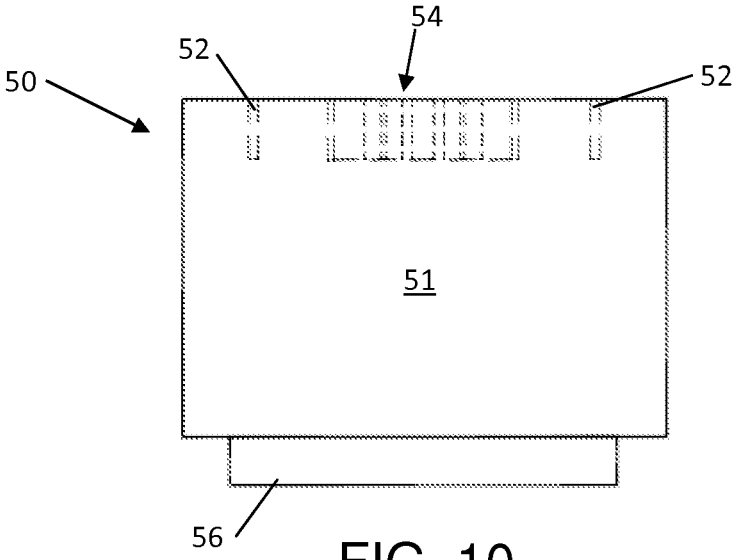
FIG. 10 is top view of the receiving device shown in FIG. 9.

FIGS. 9 and 10 depict a receiving device 50 in accordance with an embodiment of the present invention. The receiving device 50 may include a receiving housing 51, and at least one alignment key receiver 52 shaped to receive the mating end 16 of the alignment key 18 of the device 10. The alignment key receiver 52 may be fixed relative to the housing 51 of receiving device 50. The alignment key receiver 52 may have a particular orientation or shape such that the device 10 can only be mated with the receiving device 50 if the alignment key 18 with mating end 16 is in a particular rotational index position. Because the mating end 16 may be male or female, the alignment key receiver 52 should have a corresponding, opposite male or female shape such that the device 10 can mate with receiving device 50. Receiving device 50 also includes a plurality of mating electrical contacts 54. The mating electrical contacts 54 can be configured to mate with electrical contacts 14 of device 10.

In one embodiment, the receiving device 50 is a dongle, that has a second set of electrical contacts 56 for mating with a corresponding set of electrical contacts. The plurality of electrical contacts 56 can be arranged in any suitable mating arrangement. In another embodiment, the second set of electrical contacts 56 is replaced with a wire that is in electrical contact with an electronic device. For example, the wire (not shown) could be similar to cable 15 of device 10. Alternatively, the device 50 can be integrally formed with an electronic device (not shown).

Figure 11:
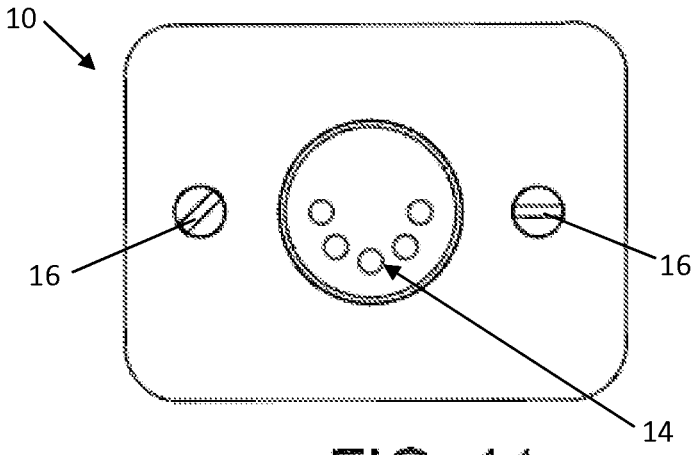
FIG. 11 is a front view of the plug-to-socket keying device shown in FIG. 1 having alignment keys that have been moved into new respective rotational index positions relative to the device's housing.

FIG. 11 shows the plug-to-socket keying device 10 having a plurality of alignment keys 18 that have been rotated into respective rotational index positions. The number of rotational index positions can vary depending on the shape of the indexing segment 20 and the detent portion 22. For example, in the embodiment shown in the drawings, each indexing segment 20 and detent portion 22 are octagon-shaped, such that the rotational index positions are angularly spaced in 45° increments. Other configurations are possible as the number of rotational index positions (and position of the alignment key 18 and/or mating end 16 relative to the housing 12 of device 10) can vary by the shape of the indexing segment 20 and/or detent portion 22. Each of the plurality of alignment keys 18 can be set to a respective rotational index position independently of the other alignment keys 18.

Figure 12:
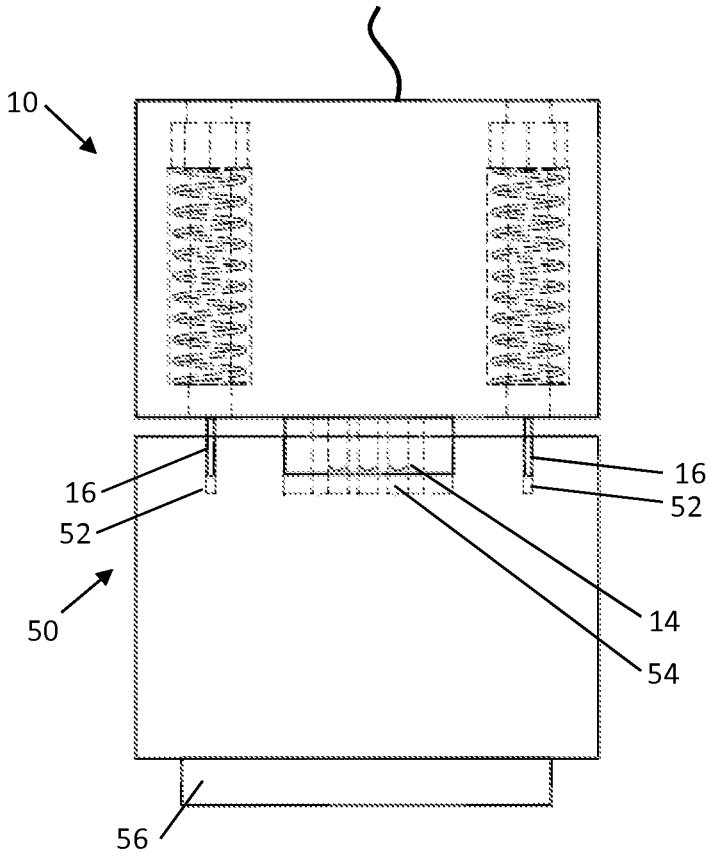
FIG. 12 is a top view of a system comprising the plug-to-socket keying device shown in FIG. 1 mating with the receiving device shown in FIG. 9.

FIG. 12 shows the plug-to-socket keying device 10 being inserted into receiving device 50. The receiving device 50 may be configured such that the mating end(s) 16 must be in particular rotational index position(s) in order for device 10 to mate with receiving device 50. In one embodiment, the alignment key receiver(s) 52 are fixed relative to the receiving housing 51, such that the corresponding mating end(s) 16 must be placed in a particular rotational index position in order for the device 10 to mate with receiving device 50. This can be used to ensure compatibility between the electronic devices that are connected via the mating connection of device 10 and receiving device 50. Additionally, device 10 can be adjusted to mate with different receiving device(s) 50 having alignment key receiver(s) 52 positioned to receive a mating end 16 of device 10 in varying rotational index positions.

Thus, in accordance with the present invention, various electronic devices may have their own unique key signature determined by a set of predetermined rotational index positions of one or more alignment keys 18. As may be understood, the present invention provides a universal electrical connector capable of providing electrical connection for a multitude of electronic devices of different types, while also prohibiting accidental incompatible connection.

Modifications and other embodiments of the invention set forth herein will be apparent to one skilled in the art to which the invention pertains in light of teachings presented in the present specification. Therefore, the invention is not to be limited to the specific embodiments disclosed, and modifications and other embodiments are intended to be included within the scope of the appended claims.

PARTS LIST

10 Plug-to-socket keying device
12 Housing
14 Electrical contact(s) of keying device
15 Wire
16 Mating end of an alignment key
18 Alignment key
19 Rotational axis of alignment key
20 Indexing segment of alignment key
21 Adjustment recess
22 Detent portion of adjustment recess
24 Spring
25 Radial shoulder
26 Rod of alignment key
28 Tool access portion of adjustment recess
30 Tool recess
50 Receiving device
51 Receiving housing
52 Alignment key receiver
54 Mating electrical contact(s) of receiving device
56 Second mating electrical contact(s) of receiving device 50

What is claimed is:

1. A plug-to-socket keying device, comprising:

a housing having an adjustment recess therein, the adjustment recess including a detent portion;

a plurality of electrical contacts carried by the housing, the plurality of contacts facing a first direction relative to the housing;

an alignment key including a mating end facing the first direction and an indexing segment connected to the mating end, wherein the indexing segment is shaped to define a plurality of rotational index positions of the alignment key;

the alignment key being axially movable relative to the adjustment recess between a set position wherein the indexing segment is received by the detent portion so as to prevent rotation of the alignment key relative to the housing and an adjustment position wherein the indexing segment is removed from the detent portion so as to allow rotation of the alignment key relative to the housing; and a spring arranged to bias the alignment key toward the set position;

wherein the alignment key is settable to a chosen one of the plurality of rotational index positions by temporarily moving the alignment key into its adjustment position and rotating the alignment key to the chosen rotational index position;

whereby an angular orientation of the mating end of the alignment key is configurable by a user.

2. The device of claim 1, wherein the mating end of the alignment key is located at a first side of the housing, and the adjustment recess further includes a tool access portion through a second side of the housing opposite the first side of the housing to permit access to the alignment key through the second side of the housing.

3. The device of claim 2, wherein the tool access portion of the adjustment recess is configured to receive a screw-driver.

4. The device of claim 1, wherein the alignment key includes a rod connecting the mating end to the indexing segment, and the spring is a coil spring arranged about the rod.

5. The device of claim 4, wherein the adjustment recess defines a radial shoulder spaced from the detent portion, and the spring has a first end engaging the radial shoulder and a second end engaging the indexing segment.

6. The device of claim 4, wherein the indexing segment is slidable along the rod.

7. The device of claim 4, wherein the indexing segment is fixed to the rod.

8. The device of claim 1, wherein the plurality of electrical contacts form a standard electrical connector selected from the following list of standard electrical connector types: DIN and D-sub.

9. The device of claim 1, wherein the housing further has a second adjustment recess therein, the second adjustment recess including a second detent portion, and wherein the device further comprises:

a second alignment key including a second mating end facing the first direction and a second indexing segment connected to the second mating end, wherein the second indexing segment is shaped to define a plurality of rotational index positions of the second alignment key;

the second alignment key being axially movable relative to the second adjustment recess between a set position wherein the second indexing segment is received by the second detent portion so as to prevent rotation of the second alignment key relative to the housing and an adjustment position wherein the second indexing segment is removed from the second detent portion so as to allow rotation of the second alignment key relative to the housing; and a second spring arranged to bias the second alignment key toward the set position thereof;

wherein the second alignment key is settable to a chosen one of the plurality of rotational index positions of the second alignment key by temporarily moving the second alignment key into its adjustment position and rotating the second alignment key to the chosen rotational index position of the second alignment key;

whereby an angular orientation of the second mating end of the second alignment key is configurable by a user.

10. The device of claim 1, further comprising an electrical cable physically connected to the housing and electrically connected to the plurality of electrical contacts.

11. The device of claim 1, wherein the plurality of rotational index positions are angularly spaced at regular intervals.

12. The device of claim 1, wherein the plurality of rotational index positions are angularly spaced at regular 45° intervals.

13. The device of claim 1, wherein the indexing segment and the detent portion of the adjustment recess have corresponding polygonal shapes.

14. A plug-to-socket keying system, comprising:

a keying device, including:

A) a housing having an adjustment recess therein, the adjustment recess including a detent portion;

a plurality of electrical contacts carried by the housing, the plurality of contacts facing a first direction relative to the housing;

an alignment key including a mating end facing the first direction and an indexing segment connected to the mating end, wherein the indexing segment is shaped to define a plurality of rotational index positions of the alignment key;

the alignment key being axially movable relative to the adjustment recess between a set position wherein the indexing segment is received by the detent portion so as to prevent rotation of the alignment key relative to the housing and an adjustment position wherein the indexing segment is removed from the detent portion so as to allow rotation of the alignment key relative to the housing; and a spring arranged to bias the alignment key toward the set position;

wherein the alignment key is settable to a chosen one of the plurality of rotational index positions by temporarily moving the alignment key into its adjustment position and rotating the alignment key to the chosen rotational index position;

whereby an angular orientation of the mating end of the alignment key is configurable by a user; and B) a receiving device, including:

a receiving housing;

a plurality of mating electrical contacts carried by the receiving housing configured to mate with the plurality of electrical contacts of the keying device; and an alignment key receiver, shaped to receive the mating end of the alignment key of the keying device, wherein the alignment key receiver is fixed relative to the receiving housing.

15. The system of claim 14, wherein the receiving device further includes a second plurality of mating electrical contacts for mating the receiving device with a medical device.

16. A plug-to-socket keying device, comprising:

a housing;

a plurality of electrical contacts carried by the housing and extending away from the housing in a first direction, the electrical contacts forming one of the following electrical connector types: DIN and D-sub;

a plurality of keying mechanisms, the housing having a respective adjustment recess for each of the plurality of keying mechanisms, each keying mechanism including:

an alignment key including a mating end facing the first direction and an indexing segment connected to the mating end, wherein the indexing segment is shaped to define a plurality of rotational index positions of the alignment key;

the alignment key being axially movable relative to the adjustment recess of the alignment key between a set position wherein the indexing segment is received by the detent portion so as to prevent rotation of the alignment key relative to the housing and an adjustment position wherein the indexing segment is removed from the detent portion so as to allow rotation of the alignment key relative to the housing; and a spring arranged to bias the alignment key toward the set position;

wherein the alignment key is settable to a chosen one of the plurality of rotational index positions by temporarily moving the alignment key into its adjustment position and rotating the alignment key to the chosen rotational index position;

whereby an angular orientation of the mating end of the alignment key associated with each of the plurality of keying mechanisms is independently configurable by a user.

* * * * *